US006089026A

United States Patent [19]

Hu

[11] Patent Number: 6,089,026

[45] Date of Patent: Jul. 18, 2000

[54] GASEOUS WAVE REFRIGERATION DEVICE WITH FLOW REGULATOR

[76] Inventor: Zhimin Hu, 101 Natick Ave., Cranston, R.I. 02921

[21] Appl. No.: 09/277,679

[22] Filed: Mar. 26, 1999

[51] Int. Cl.[7] ..... F25B 9/00

[52] U.S. Cl. ..... 62/6

[58] Field of Search ..... 62/6, 467

[56] References Cited

U.S. PATENT DOCUMENTS

| | | | |
|---|---|---|---|
| Re. 31,683 | 9/1984 | Bauer | 239/614.06 |
| 962,836 | 6/1910 | Hildebrandt | 62/11 X |
| 1,027,862 | 5/1912 | Von Linde | 62/11 X |
| 2,524,397 | 10/1950 | Roberts et al. | 62/11 |
| 2,765,045 | 10/1956 | Meyers | 208/340 |
| 2,765,054 | 10/1956 | Meyers | 208/340 |
| 2,825,204 | 3/1958 | Kadosch et al. | 60/263 |
| 3,200,607 | 8/1965 | Williams | 62/86 |
| 3,314,244 | 4/1967 | Green | 62/86 |
| 3,526,099 | 9/1970 | Pavlin et al. | 62/467 |
| 3,541,801 | 11/1970 | Marchal et al. | 62/467 |
| 3,559,373 | 2/1971 | Garrett | 62/467 |
| 3,653,225 | 4/1972 | Marchal et al. | 62/467 |
| 3,828,574 | 8/1974 | Boy-Marcotte et al. | 62/467 |
| 3,828,754 | 8/1974 | Boy-Marcotte et al. | 62/467 |
| 3,865,143 | 2/1975 | Curto et al. | 137/826 |
| 3,889,484 | 6/1975 | Van Der Horst et al. | 62/86 |
| 3,904,514 | 9/1975 | Marchal et al. | 62/6 |
| 4,231,519 | 11/1980 | Bauer | 239/102 |
| 4,383,423 | 5/1983 | Lenglet et al. | 62/467 |
| 4,444,019 | 4/1984 | Arkiharov et al. | 62/87 |
| 4,458,708 | 7/1984 | Leoard | 137/9 |
| 4,495,967 | 1/1985 | Needham et al. | 137/614.06 |
| 4,504,285 | 3/1985 | Modisette | 62/467 |
| 4,531,371 | 7/1985 | Voronin | 62/6 |
| 4,549,567 | 10/1985 | Herten | 137/262 |
| 4,562,867 | 1/1986 | Stouffer et al. | 137/811 |
| 4,625,517 | 12/1986 | Miller | 60/721 |
| 4,722,001 | 1/1988 | Hofler | 62/467 |
| 4,722,201 | 2/1988 | Hofler | 62/467 |
| 4,858,441 | 8/1989 | Wheatley et al. | 62/6 |
| 4,905,909 | 3/1990 | Woods | 239/589.1 |
| 4,953,366 | 9/1990 | Swift et al. | 62/467 |
| 5,319,948 | 6/1994 | Blum et al. | 62/467 |
| 5,412,950 | 5/1995 | Hu | 62/6 |
| 5,519,999 | 5/1996 | Harpole et al. | 62/6 |
| 6,021,643 | 2/2000 | Swift et al. | 62/6 |

*Primary Examiner*—William Doerrler

[57] ABSTRACT

This invention provides a gaseous wave refrigeration device (GWRD) primarily comprising an adjustable nozzle, an adjustable oscillating chamber, a bundle of resonant tubes, a flow regulator, wave impedors, and a chiller to monitor the gaseous wave behavior in GWRD and to produce the refrigeration effectively in the condition of varying flow state through GWRD. This characteristic is achieved by means of controlling resonant periodic flow phenomenon of gaseous column and wave interactions through the adjustment of said adjustable nozzle and adjustable oscillating chamber under varying conditions of flow states in pressurized supplying gas streams to retain the optimal performance of GWRD. With this characteristic, the GWRD in the present invention can be applied in practices to fit the controlling requirements on fluctuations of system operations in industries.

6 Claims, 4 Drawing Sheets

GASEOUS WAVE REFRIGERATION DEVICE WITH FLOW REGULATOR

BACKGROUND OF THE INVENTION

This invention provides a gaseous wave refrigeration device (GWRD) with a flow regulator, a wave impedor, and chiller to monitor the gaseous wave behavior in GWRD and to produce the refrigeration effectively. This characteristic is achieved by means of controlling resonant periodic flow phenomenon of gaseous column and wave interactions under varying conditions of flow states in pressurized supplying gas streams through GWRD.

As is known widely in the industrial fields, gaseous expansion refrigeration processes are applied in a variety of operations, such as condensation, gas separation, gas liquefaction, and oil refining of traditional chemical and petroleum industries. Meanwhile, the rapid development of small mechanical cryocoolers in the high-tech fields which use the gas expansion cycles over the past decades is due to the emergence of specific applications in low-temperature operation with the requirement of a long life running. All of them are operated under pressurized gases expansion processes or relative gaseous expansion cycles. The primary feature of gas expansion cooling devices afore-mentioned is that the temperature drop or cooling load is obtained by the cycle extracting the energy or work from the expanded gases by mechanic parts—either the type of pistons, displacer, or impellers.

Generally speaking, gaseous cooling devices may vary according to different mechanic structure, device size, operating conditions, and thermodynamics cycles. However, they can all be classified by the cooling capacity and the range of applications of such a device in the systems. For instance, many gaseous expansion equipments such as turbines and piston expanders are designed for high cooling capacity mainly in petrochemical industries, whereas small cryocoolers such as G-M coolers, Stirling coolers, pulse-tube coolers, and adsorption cooler for the applications in infrared detectors for earth observation, night vision, and missile guidance are mainly designed to work under different working environments with small cooling capacity.

However, Almost all the current cooling devices designed have one common feature in terms of their cooling mechanism: they all have mechanically moving parts to absorb pressure energy from cold gases and to achieve the cooling effects. The utilization of mechanical structures in the gaseous expansion device improves the operation efficiency in thermodynamic cycles and increases the cooling effect. On the other hand, it causes the drawbacks of low running reliability, high cost of maintenance, limitation of operation conditions. Therefore, in past several decades new efforts had been made to develop the new type of gaseous expansion devices in order to overcome the fatal disadvantage in the traditional devices Due to the development of new technology and the stimulation in the relative high-technical industries such as magnetic resonance imagery systems, superconductivity applications, and high energy facility, there has been an increasing interest in developing new devices for extreme special conditions with very high pressure drop, very lower temperature environment, long-life running, and fluctuating operating condition, etc. where the traditional cooling devices for gaseous expansions fail or lack inefficiency. In order to replace inefficient traditional equipment and retain merits of simple structure, low initial investment, and low maintenance cost, considerable improvements have been made in this field for the consideration of effective operation as employed in the previous arts by U.S. Pat. Nos. 2,765,045, 2,825,204, 3,200,607, 3,314,244, 3,541,801, 3,526,099, 3,559,373, 3,653,225, 3,828,574, 3,889,484, 3,904,514, 4,383,423, 4,444,019, 4,504,285, 4,531,371, 4,625,517, 4,722,001.

All the inventions have limited success in overcoming the problems mentioned, because they all contain some moving parts which will usually lead to low liability and high maintenance cost though some of them are operated on the improved mechanism or structure. Generally, in order to avoid the mechanically moving parts as required by system reliability, Joule-Thomson valves (throttling valves) have to be used as the element to obtain cooling capacity. The mechanism of the J-T valves is based on an isoenthalpic process during the pressure drop of gas expansion. Although it is still the most popular alternative for industrial gaseous expansion and pressure regulation processes owe to its simplicity, reliability, low cost maintenance, and easy controllability, nevertheless, J-T valves have a very low cooling efficiency which results in high loss of pressure energy in the gas cooling processes. Obviously, its wide application is due to the fact that to obtain cooling effect by pressure reduction in the certain technical processes, using throttling valves instead of traditional energy extracting machines is the only possible solution to the extreme working conditions such as high pressure and two-phase flow.

Therefore, a device which will increase the cooling efficiency without any mechanical moving parts and at the same time retain the merit of J-T valves always challenges the manufacture of gas expansion equipment and attract the industrial users.

In the previous arts, the idea to create cooling effect by means of gaseous wave interaction in periodic unsteady flows has already been proved and reported by U.S. Pat. Nos. 3,541,801, 3,653,225, 3,828,574, 4,625,517, 4,722,001, especially 5,412,950. However, none of the previous arts with these and other mechanism have ever proposed a device running effectively with the merits of no moving parts, simplicity, reliability, easy regulation, and low cost for maintenance under the varying flow conditions which frequently occurs in industrial practices. Therefore, the prior patents with these and other mechanism have limitations in terms of their efficiency, simplicity, controllability, and reliability in the scope of industrial applications. Although there are several devices which used a pulsating flow to generate cooling effect in prior art patents, there still exists no device with enough cooling capacity, free of complex structure and moving parts, and suitable for the controllability for flow state fluctuation like valves in industrial practice. In addition, it is also very difficult to find the existing gaseous cooling devices which can work effectively (or to be more specific limitation in cooling capacity, or won't have the required stable operation) under the condition of varying flow state in industrial systems within the high pressure drop range as well. These and other difficulties experienced with prior arts of gaseous cooling devices and the needs of engineering applications in the variation of operating flow conditions have been motivated in a novel manner of the present invention.

In comparison with traditional refrigeration equipment and the existing types of gaseous wave refrigeration devices in the previous arts, the present invention, for its primary object, introduces an apparatus, which works by using the mechanism of resonant gaseous wave for cooling processes under the varying condition of flow state. The present invention overcomes the limitations and weak points with the previous arts in terms of gaseous wave refrigeration device in U.S. Pat. No. 5,412,950.

The Applicant's apparatus in the present invention is designed for the GWRD operation under the varying condition of flow state in supplying pressurized gas stream, which is often met in all industrial systems and makes the GWRD operation inefficiency or failure. The apparatus's operation is established on the special mechanism to control gaseous wave resonance flow production for the best performance of GWRD by the mechanical regulating structure which can minimize the effect of flow state variation on the periodic gaseous wave system behavior. In addition, the apparatus in the present invention can also be adjusted to responses the variation of active flow state as required by monitoring processes in most industrial systems. The apparatus in the present invention is especially suitable for technical processes in industries where the flow state of supplying pressurized gas stream is needed to be monitored actively and adjustable manually to obtain the effective cooling operation, or the case in which the respondence has to be taken for the passive fluctuation of flow states in supplying pressurized gas stream due to undesirable reasons.

Most importantly, the present invention also improves over the previous art U.S. Pat. No. 5,412,950 which failed to produce cooling effect efficiently at varying flow state due to the change of gaseous wave interactions in the oscillating chamber. By contrast, the gaseous wave refrigeration apparatus in the present invention provides an effective instrument for systems and processes in petrochemical and natural gas industries where (a) conventional throttling valves have been used to generate the cooling effect, (b) the flow state passing the throttling valve is needed to be actively monitored and adjustable for the required variation of cooling load and optimized operation, and (c) the flow state changed passively due to the need of processes operation in which the maximum cooling effect is hardly obtained for the required load from existing throttling valves.

In short, the present invention aims at meeting several important objectives. The first is to provide a gaseous wave refrigeration apparatus for applications where traditional expansion machines can not be used or are used with low efficiency at varying flow states.

The second is to provide a gases wave refrigeration apparatus for replacement of throttling valves with a flow state regulator manually to monitor actively the recovery of the high pressure drop energy from the gaseous expansion processes in industrial systems.

The third is to provide a gaseous wave refrigeration apparatus to handle the flow state variation passively in industrial system and generate the maximum cooling performance by adjusting the wave interaction behavior in said gaseous wave refrigeration apparatus.

The last is to provide a gases wave refrigeration apparatus which can operate under the extreme high pressure drop by means of a multi-stage operation in series. Meanwhile, the flow state in each stage can also be controlled by means of a flow regulator in GWRD for maximum pressure energy recovery and cooling effect without using any moving parts.

With these and other objectives in view, as will be apparent to those skilled in the art, the invention resides in the combination of parts set forth in the specification and covered by the claims appended hereto.

SUMMARY OF INVENTION

The apparatus (GWRD) in the present invention employed a means to monitor the gaseous wave behavior inside GWRD and produce the refrigeration effectively under conditions of flow state variations in pressurized supplying gas streams through GWRD. It is accomplished by controlling resonant periodic flow phenomenon of gaseous column and wave interactions using an adjustable nozzle within a mobile space of oscillating chamber, a wave impedor, and a chiller. The apparatus primarily comprises, a flow buffer chamber, a jet nozzle which is adjustable to response the varying flow state by changing its cross-section at the exit, a mobile oscillating chamber which contains a regulating unit to retain a steady high speed jet oscillation and respond to the nozzle adjustment synchronously, a flow stabilizer which reduces the interacting mixture in the outflow of the resonant tube bundles, a bundle of resonant tubes which produces and dominates a pulsating flow in the mobile oscillating chamber and converts the gas stream kinetic energy into cooling and heating effect by means of the interaction of resonant waves, thermal isolators which are linked between the mobile oscillating chamber and each of resonant tubes to isolate the heat conducted from resonant tubes into the mobile oscillating chamber, a wave impedor which can modulate the periodic shock wave system to reduce the reheating effect of reflected compressive wave on cold gases in the aperture of resonant tubes, and a chiller which is used to enhance the heat transfer from the surface of resonant tubes.

Generally stated, the apparatus in the present invention is designed to retain the best performance of GWRD operation under the conditions of varying flow states. Variations of flow states are the common cases in which GWRD is enforcedly operated in the off-designed working condition due to the expectable or undesirable reasons in practices. From experimental observations of the previous art U.S. Pat. No. 5,412,950, the changes of flow state through GWRD influences seriously the spontaneously self-sustained oscillation of high speed jet occurred in the oscillating chamber, which makes the off-designed operation of GWRD very ineffective.

As a matter of GWRD operation, pressurized supplying gas streams converts its pressure energy into the kinetic energy and forms a high-speed jet through the nozzle. When entering the oscillating chamber with a special confined space, the high speed jet structure maintained by pressurized gas stream in the steady flow state, will be dominated by its inherent characteristics, such as the length of shear layer separation region, the non-uniform flow entrainment, and the turbulent diffusion at downstream. Those parameters critically determines the jet deflect behavior apart from the flowing direction of the nozzle exit axis. As the deflected high-speed jet impacts with each of the resonant tubes which are placed into the instability region of high-speed jet structure, a feedback phenomenon of the pressure waves is produced along the high-speed jet. As a result, this pressure feedback pushes the high-speed jet moving normal to its flowing direction in the oscillation chamber and sweeping over the inlets of resonant tubes to make the pressure feedback in succession. With the GWRD operates at a steady status, the feedback process is entirely depended on several critical parameters, such as resonant tube forms, interference spacing between the nozzle exit and resonant tube inlet, a structure of the stabilizer, geometrical shape of oscillating chamber, and length of the each resonant tube. Those parameters dominate to sustain a steady periodic jet flapping process in the oscillating chamber and a resonant cooling effect in GWRD.

Normally, the steady flow state at the designed-point is the nominal operating conditions required by system operations, by which the GWRD is designed to achieve the expected cooling capacity. In industrial systems, occasionally, the flow state in the pressurized supplying gas stream varies due to the fluctuation of system productivity and undesirable factors in supplying gas sources. Such a change in the flow state of supplying gas sources will result in the GWRD to be operated in off-design conditions and degrade the performance efficiency because the structure of the high-speed jet will consequentially follow the flow state varying. In this case, the reorganization of the jet structure in varying flow state normally weakens or disorders the periodic feedback processes between the jet and resonant tube bundles which sustains the periodic oscillation of high speed jet in the chamber. Once disordered jet oscillation happens, the GWRD operation fails due to that the energy conversion inside resonant tubes is degraded or disappeared.

As to maintain effective operations, the apparatus in the present invention involves an adjustable nozzle and a mobile oscillating chamber to generate a stable operation of GWRD under the condition of varying flow states. The adjustable nozzle and the oscillating chamber are simply designed to be moved simultaneously in the direction perpendicular to jet flow. By this mechanism, it will retain the high-speed jet structure at the designed condition and diminish the effect of varying flow states on the oscillating chamber in the certain range. Meanwhile, the steady performance of GWRD will be established upon the adjustment of the mobile nozzle and the oscillating chamber simultaneously, which make the jet oscillation and wave system interaction behavior in order. In addition, the uses of a wave impedor and a chiller will reduce the sensitivity of the high-speed jet structure and sustained-oscillation to the flow state variation.

BRIEF DESCRIPTION OF THE DRAWINGS

The characteristics of GWRD in the present invention, may be best understood by reference to one of its structural forms illustrated by the accompanying drawings in which.

DETAILED DESCRIPTIONS OF THE PREFERRED EMBODIMENT

Figure 1:
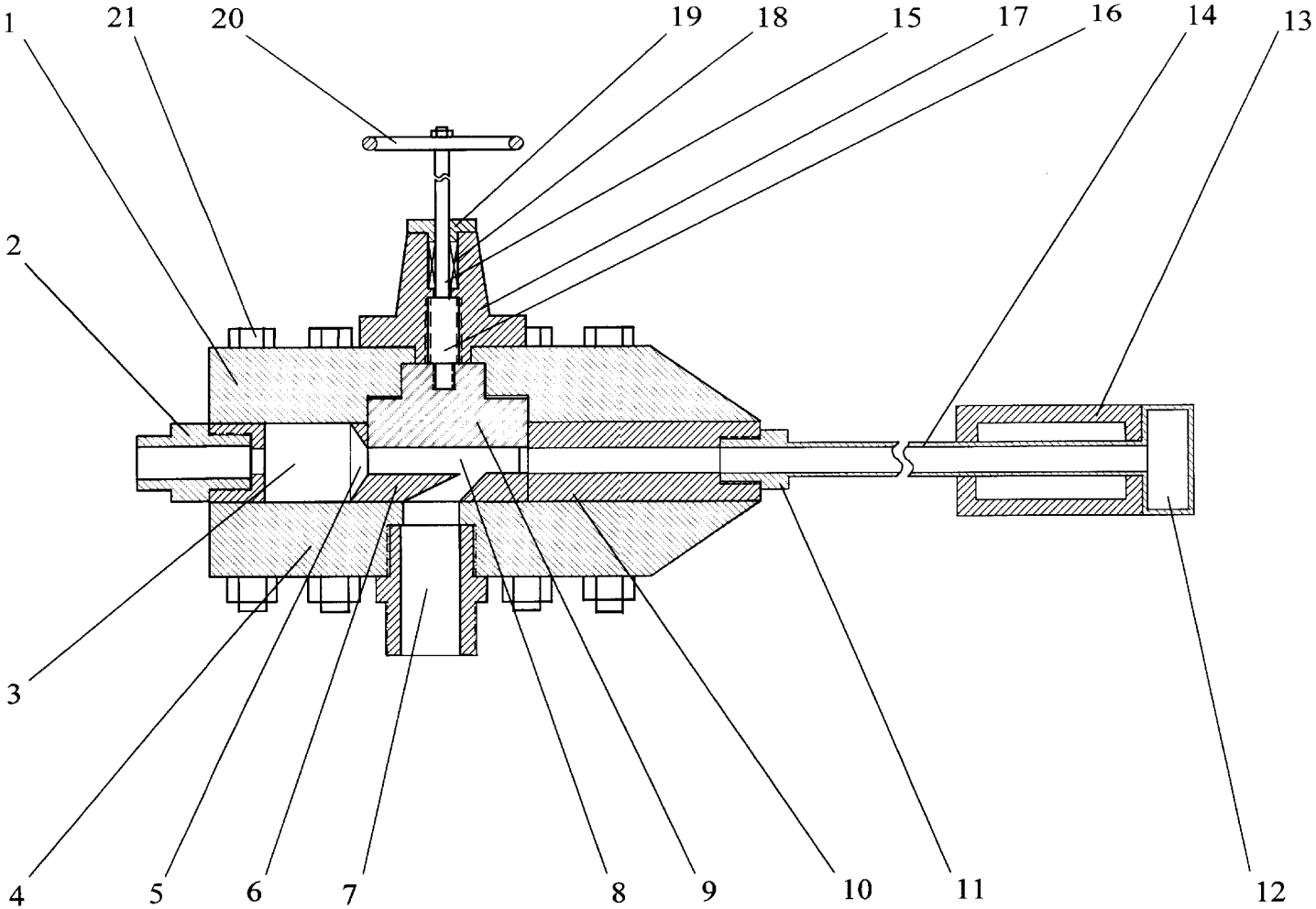
FIG. 1 is an exploded side view of the GWRD apparatus

By the side exploded view, FIG. 1 best describes the general features of mechanical structure of the GWRD in the present invention. The said GWRD apparatus comprises a upper cover plate 1, a inlet conduit 2, a flow buffering chamber 3, a lower cover plate 4, a nozzle 5 which has the convergent or convergent-divergent passage and is connected with the flow buffering chamber 3, a vortex stabilizer 6, a discharging conduit 7, an oscillating chamber 8 which is arranged in series of the convergent nozzle 5 and connected to one end of each of the resonant tubes, a flow regulator 9, a middle operating plate 10, thermal isolated connectors 11 which connect between the middle operating plate 10 and the open end of each resonant tube 14, wave impedors 12 which are connected to the other end of each resonant tube, a chiller 13 which is penetrated by all resonant tubes, a bundle of resonant tubes 14, a regulating spindle 15 which is linked to flow regulator 9, a screw cage 16 which holds and moves the spindle 15 up or down when the spindle 15 is rotated, a regulator holder 17, a packing gland 18, a bushing 19, a handwheel 20, fasten bolts 21.

Figure 2:
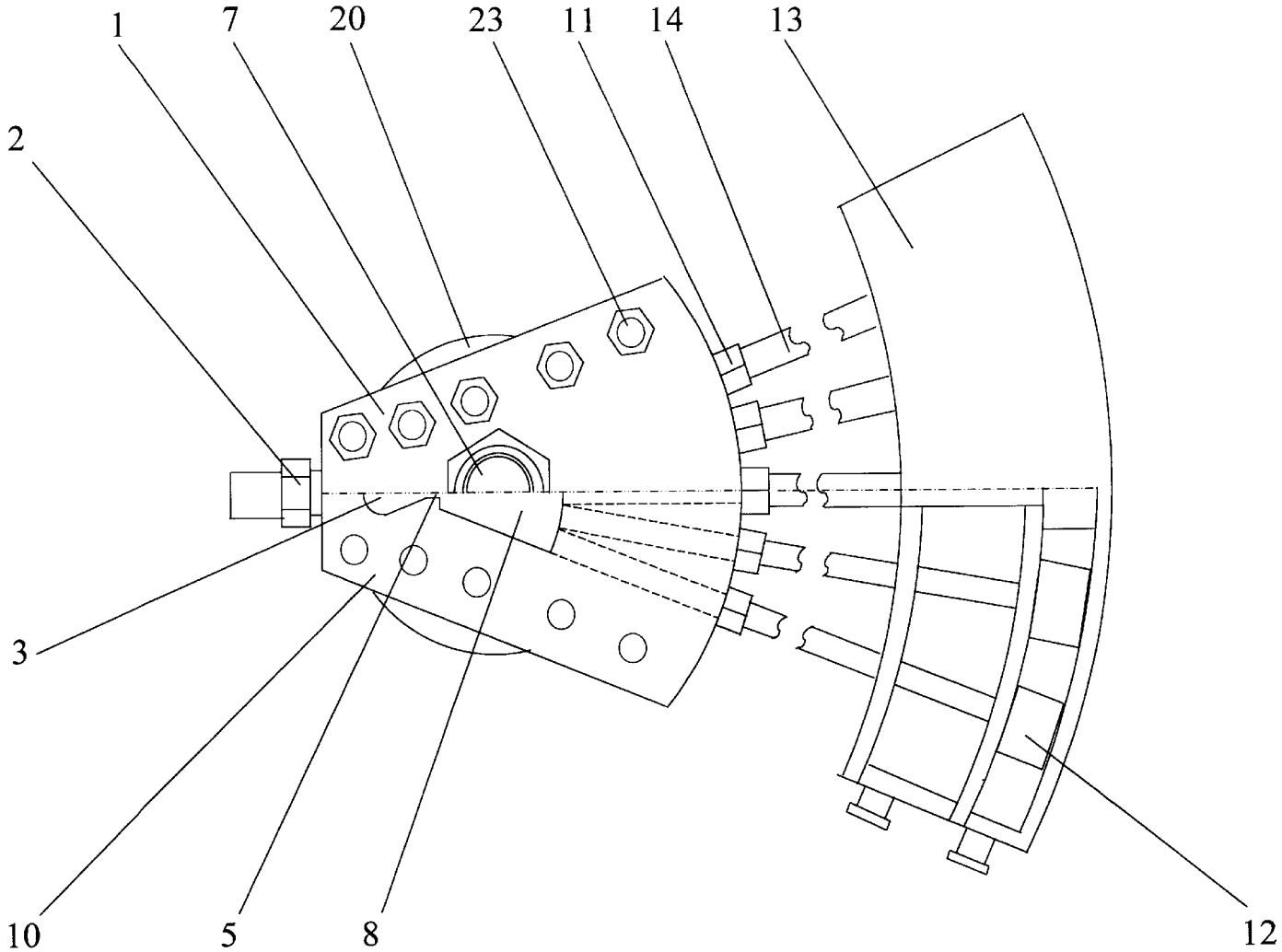
FIG. 2 is a bottom view with partially exploded view of GWRD apparatus.
Figure 3:
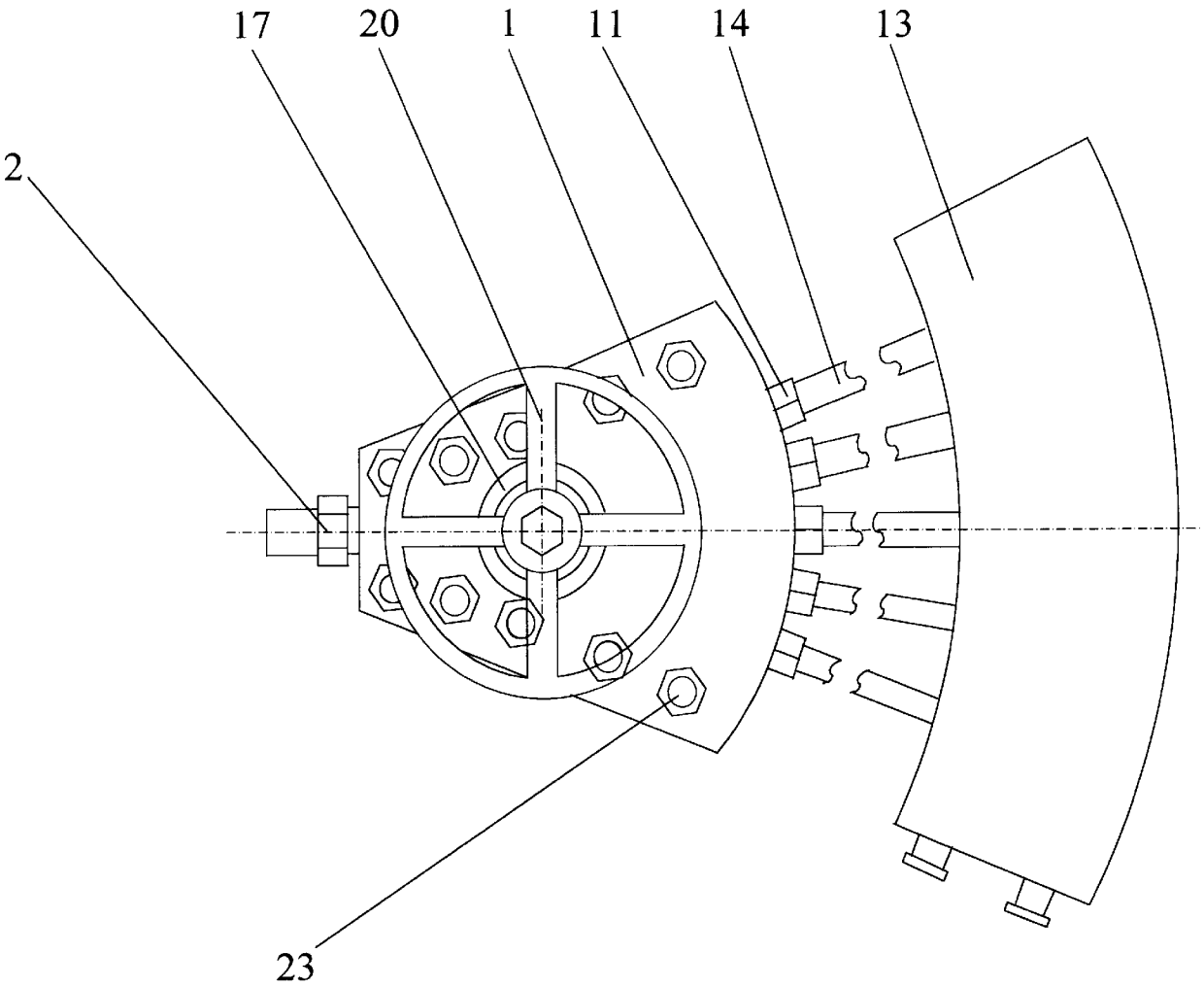
FIG. 3 is a top view of GWRD apparatus in the present invention.
Figure 4:
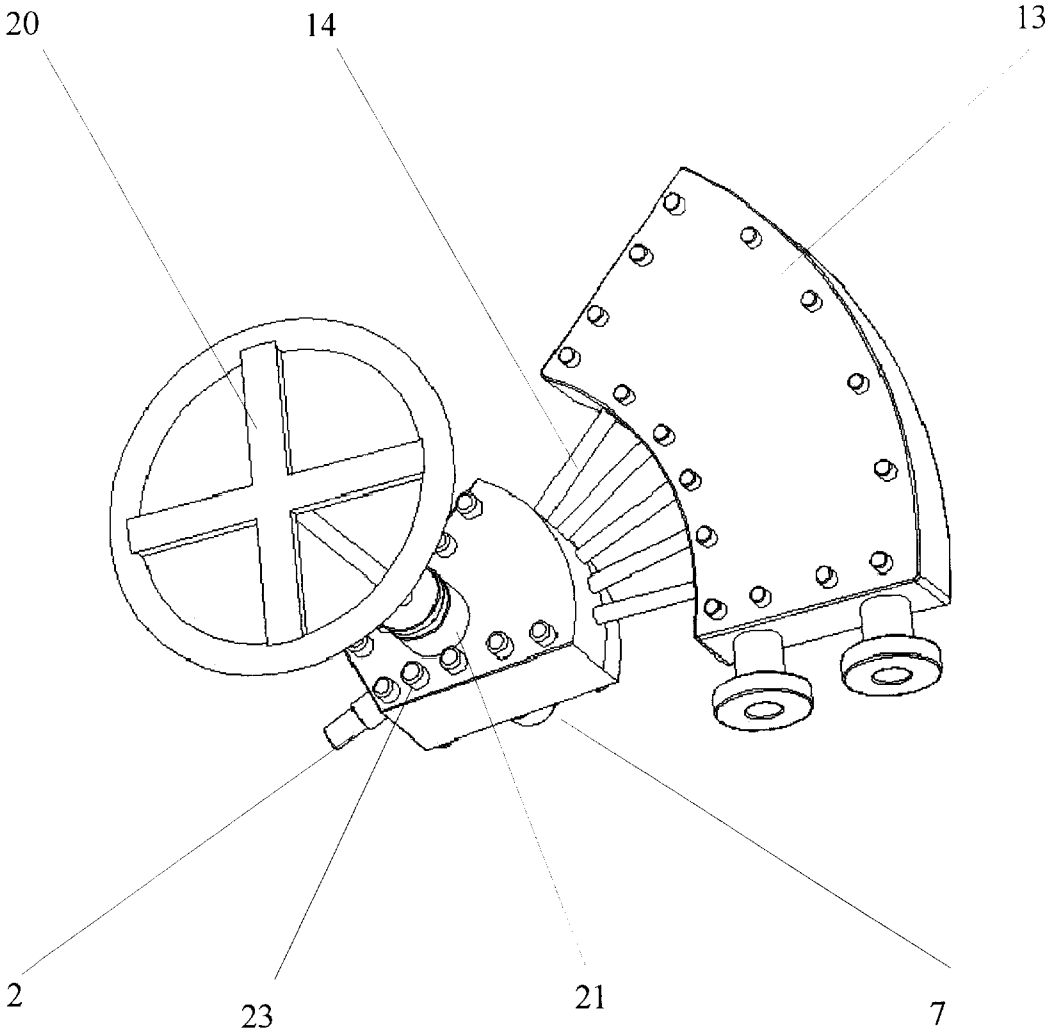
FIG. 4 is a perspective schematic view of the GWRD apparatus

Again referring to FIGS. 2 and 3, the upper cover plate 1 and lower cover plate 4 hold the middle operating plate 10 from both sides by several fasten bolts 21 to form the main body of GWRD. The said middle operating plate 4 contains the buffer chamber 3, the nozzle 5, and the mobile oscillating chamber 8. The said middle operating plate 4 is directly connected to one end of the bundle of resonant tubes 10 in the way from the side wall through the thermal isolated connector 11, by which to form a fan shape distribution in the external extent of resonant tubes. The inlet conduit 2 is mounted on the opposite sidewall of the middle operating plate 4 to lead the pressurized gas stream straight into the buffer chamber 3. The flow regulator 9 is assembled within the oscillating chamber 8 from the perpendicular direction to change the flow passage spacing in the oscillating chamber 8 by gradually moving into the inside of the chamber 8. The upper surface of flow regulator 9 is linked to spindle 15 which enables this to move the flow regulator 9 up and down by the rotation of the spindle 15. The spindle 15 is penetrated through the screw cage 16, the packing gland 18, and bushing 19. The end of spindle 15 is finally ferrumininated to the handwheel 20. The discharging conduit 7 is attached to the hole on the lower cover plate 4 to form the discharging passage. The discharging passage formed is connected to the vortex stabilizer 6 which is on the middle plate 10. The opening end of each resonant tube 14 is jointed to the middle operating plate 10 through each of the thermal isolated connectors 11, and the other end of each resonant tube 14 is inserted into one of wave impedors 12 which has the container shape to form the enlarged cross-section at the end of resonant tubes 14. The bundle of resonant tubes penetrate the sidewall of the chiller 13 in following their radial direction. On the sidewall of shell space of the chiller 13, there are inlet and outlet passages leading the coolant through the chiller carrying the heat away from the surface of the resonant tube bundle 14 inside the chiller 13. The bushing 19 is screwed on the holder of spindle 17 to extrude the packing gland 18. The extruded packing gland 18 seals around the cylindrical surface section of the spindle 15 to separate the internal gas stream inside the oscillating chamber 8 from the surroundings.

Further primarily referring to FIG. 1, when a pressurized gas stream with a steady flow state from discharging source flows into GWRD apparatus in the present invention, it first is led into the buffer chamber 3 by the inlet conduit 2. The turbulence and vorticity generated from the inlet passage are reduced and the stagnation pressure of the coming pressurized gas stream is recovered in the flow buffer chamber 3. Since the inlet conduit 2 is aligned to the outflow direction of the nozzle 5, the impinging loss and vorticity generation stemmed from the change of flow direction inside of the buffer chamber 3 are diminished, and the stagnation pressure of the coming pressurized gas stream is effectively retained. As the pressurized gas stream rushes out of the nozzle 5, the pressure energy of the pressurized gas stream is converted into kinetic energy, and a high speed jet structure is formed in the oscillating chamber 8. In principle, as the high-speed jet is injected into the oscillating chamber 8 with the geometrical enlargement of flow section from the nozzle 5, the flow separation is formed accompanied with the formation of high shear layer. The further development of the high speed jet entirely depends on the boundary conditions at the down stream in the oscillating chamber 8, which are, in the present case, the side wall configuration, spacing between the exit of the nozzle 5 and the aperture of resonant tubes, and the length of the resonant tubes. The configuration of the confined space in the oscillating chamber 8 will seriously influence the stability of high-speed jet.

However, as to excite the instability of high-speed jet and form the periodic self-sustained oscillation inside the oscillating chamber 8, those geometrical parameters have been carefully selected under the given operating condition of GWRD. For the purpose of producing a periodically unstable jet flow in the oscillating chamber 8, the offset of the side walls in the oscillating chamber 8 plays a key role to make the jet deflection to one side of both walls in the oscillating chamber 8. With the formation of the high-speed jet bending, the status of critical neutral stability is established in the oscillating chamber 8, under which it is easily triggered into an unstable jet by small pressure disturbances from downstream. If there is no downstream boundary, for instance, without the existence of resonant tubes, the high-speed jet will steadily stay in the bending state at the initial side of the walls. As a matter of fact, the existence of the bundles of resonant tubes 14 at downstream of the oscillating chamber 8 functions to generate the pressure wave disturbances, and triggers the instability of the bending jet.

In addition, once the bending jet in GWRD reattaches at the initial side wall of the oscillating chamber, it impacts with one of the bundle of resonant tubes 14 at downstream, a strong pressure wave disturbance is produced immediately at the aperture region of those tubes due to the instantaneous accumulation of fluid mass. This strong pressure disturbance propagates along the both directions, up and down stream around the impinging point. The one traveling to upstream, called feedback pressure wave disturbance (FPWD), has a strong effect on the bending behavior of the high speed jet, and the other moving to downstream, called incident pressure wave disturbance (IPWD), induces the resonant oscillation of the gaseous column remaining (GCR) inside the bundle of resonant tubes 14. Under the action of the generated FPWD, the state of the shear layer of high-speed jet at the sensitive region out of the nozzle 5 has been changed and becomes unstable. The adjustment of the bending behavior of high-speed jet in the oscillating chamber 8 results from the FPWD arrivals at the nozzle 5 exit. The state variations of the shear layer in the outlet region of nozzle 5 gradually changes the initial direction of jet flow which generates the movement of the bending jet step by step in the oscillating chamber 8 as it sweeps over each aperture of the resonant tubes 14. The identical interaction processes between the jet and the resonant tubes will begin when the moving high-speed jet reaches the other sidewall of the oscillating chamber 8. Based on the mechanism of FPWD interacting with the high-speed jet, a lateral self-sustained oscillation of high-speed jet is generated to form the fundamental operation of the apparatus in the present invention. When the self-sustained oscillation is triggered, the high-speed jet flaps periodically over all the apertures of the bundle of resonant tubes 14.

Associated with the excited jet oscillation aforementioned, the cooling effect is obtained in the vicinity of the aperture of the bundle of resonant tubes 14. It is because the periodic generation of IPWD at the apertures of resonant tubes induce GCR oscillations during the jet interacting with GCR, and removes the energy from the gas portion injected by the flapping jet. As IPWD propagates from the aperture toward the closed end of resonant tubes 14, the internal energy of injected gas is reduced. In fact, when the high-speed jet moves away from the impinging aperture of resonant tube, the injected gas rushes out from the resonant tube 14 into vortex stabilizer 6 with a significant temperature drop. At the moment, an incident expansion wave disturbance (IEWD) is formed and travels into the resonant tube as well.

Noticed that an interface between the injected gas and GCR is formed in the vicinity of the aperture of resonant tubes 14 to separate them into different energy regions, namely the portions of injected gas and remaining gas. The portion of injected gas is refreshed as the jet flaps over the apertures of resonant tubes, and the remaining gas resides in resonant tubes to absorb the energy released by the injected gas in the form of IPWD. Due to the contribution of nonlinear effect, the front of IPWD becomes steep during the movement. Finally, an incident shock wave disturbance (ISWD) is formed before IPWD reaches the other end of the resonant tubes 14. The majority of energy portion released by the injected gas is dissipated by (ISWD) in the remaining gas and raises the temperature of GCR significantly.

Generally speaking, the operation of GWRD in the designed flow state is based on IPWD system's performance which acts as a vehicle to transport the pressure energy from the injected gas into surroundings. This process of the energy transportation relies upon the generation of resonant oscillation coupling the high speed jet structure with the geometry of the oscillating chamber 8 and resonant tubes 14 selected for the designed flow state. Unfortunately, there are several factors effected seriously on the jet structure, including the shear layer thickness, potential core region length, shock disk position, and entrainment ratio, etc., which all are sensitive to the flow state. Due to the fact of the geometry critically creating the gaseous wave interaction spontaneously, the variation of flow state will sensitively change the GWRD operation.

Supposing that the flow state turns away the designed-point, the initial response to GWRD operation is to bring the variation of flow state at the exit of the nozzle 8. At first, the velocity at the exit of nozzle 8 will be changed which directly takes the action to the high-speed jet structure. As a consequence, the state of lateral self-sustained oscillation of high speed jet will be disturbed, weakened or will become irregular since the matching conditions to sustain the jet oscillation at the designed flow state is broken down. Apparently, the discordance of the oscillating condition directly results in the degradation of the refrigeration performance of GWRD. Observed from the experiments, the cooling performance of GWRD in the prior art of U.S. Pat. No. 5,412,950 drops down because the flow rate or supplying pressure diverges from the designed conditions. Therefore, it is realized that the adjustment of all geometrical parameters in the oscillating chamber 8 is imperative to rematch resonant oscillation conditions under the variation of flow state. The difficulty of making this adjustment is because the limitation of device size and internal leakage will result in the complexity of mechanical structure to adjust all parameters simultaneously inside the oscillating chamber 8 to match the unknown wave system conditions.

In order to recover the refrigeration performance of GWRD at the varying flow state, the apparatus of the present invention provides the method and mechanism to regulate manually the oscillating chamber 8 and nozzle 5 simultaneously to maintain the optimal cooling operation of GWRD with the simplest structure. Further referring to FIG. 1 again, it discloses the features of the apparatus in the present invention. The flow structure of a high-speed jet created in the present apparatus has the two-dimensional flow feature partially inside the oscillation chamber 8 and is uniquely determined by the exit velocity of nozzle 5. The method proposed in the present invention is to regulate the critical geometry of GWRD under the conditions of varying flow state by changing the spacing of the jet flow passage in the direction perpendicular to the two-dimensional flow space of the oscillating chamber 8. By doing this way, the jet flow structure and designed geometry will be minimally affected by the geometrical adjustment during the varying flow state. In principle, it is based on the fact that the geometrical adjustment of flow passage in the direction perpendicular to flow confined space of the oscillating chamber 8 will provide the identical flow pattern and structure of high speed jet with the designed point in the oscillating chamber 8 when the flow state varies. The adjusting procedure is accomplished by the following steps: once the flow state turns away from the designed-point, for instance in the case of the flow rate dropping down, the jet speed at the exit of the nozzle 5 will reduce immediately. The reduction of the jet exit velocity of nozzle 5 weakens the interaction of the jet with the resonant tubes 14 due to the degeneration of the jet strength. To respond to this flow rate drop, the flow regulator 9 which is inserted into the oscillating chamber 8, will be pushed down by rotating the spindle 15 manually. The left-side wall of the flow regulator 9 contacted to the exit wall of the nozzle 5, will gradually block the exiting section of the nozzle 5 from the perpendicular direction as the flow regulator 9 slides down into the oscillating chamber 8. The reduction of the flow exiting area of the nozzle 5 results in increasing the rushing velocity of high speed jet back to the designed-point value. Meanwhile, the flow passage in the oscillating chamber 8 is shrunk as the flow regulator 9 moves down which matches with the geometrical change at the exiting section of the nozzle 5. Since the simultaneous adjustment of the oscillating chamber 8 and the nozzle 5 retains the pattern of the jet flow structure at the designed point at the moment of the flow rate dropping, the self-sustained oscillation of high speed jet is retained and the cooling performance of GWRD under the varying flow state is maintained. For the reverse operation of the flow regulator 9, it will be suitable for the flow rate increasing case. Since the geometrical configuration of the oscillating chamber 8 in the middle operating plate 10 is kept with the adjustment of the spacing in the direction perpendicular to the jet flow, except for the boundary effect developed on the upper and lower walls of the oscillating chamber 8, the performance of GWRD is recovered in the certain range of flow state variation. This mechanism regulating flow pattern in the varying flow state insensitizes GWRD apparatus to the operating condition, and makes the apparatus in the present invention practicable for the industrial operations. Structurally, to seal the leakage of the pressurized gas stream inside the oscillating chamber 8 from the wall of the spindle 15 into the surroundings, the sealing unit including the regulator holder body 17, the packing gland 18, and the bushing 19 are designed. The regulator holder body 17 holds the packing gland 18 which has the annulus shape to be penetrated by the spindle 15. The packing gland 18 is tightly pressed by the bushing 19 to seal the contacted cylindrical surface of the spindle 15.

In addition, from the experimental observations, it is found that the heat generated from GWRD operation is accumulated in GCR. It results in the increment of the average temperature of GCR if the heat is not removed effectively. The heat accumulation and the temperature increase in GCR changes the state of the interface, degrades the energy transportation between the injected gases and GCR, and weakens the behaviors of IPWD and ISWD propagating in GCR. On the principle of gasdynamics, the higher the temperature of GCR, the lower the cooling efficiency generated in the injected gases. However, In order to increase the cooling effect and intensify the IPWD and ISWD behaviors for pressure energy transportation, in the apparatus of the present invention, the chiller 13 is designed to enhance the heat released from GCR. The heat generated by the resonant oscillation of GCR is carried away by the convective heat transfer between the surfaces of the bundle of resonant tubes 14 and the coolant which flows through the shell of the chiller 13. Meanwhile, the heat conducted from the resonant tubes 14 into the oscillating chamber 8 which reheats the injected gas is eliminated by the installation of the thermal isolated connector 11.

Referring to FIGS. 2 and 3 again, it is found that from experiments, as ISWD reaches the other end of resonant tubes 14, a reflected shock wave disturbance (RSWD) is generally formed which travels back along the opposite direction of ISWD if the closed-end wall of the resonant tubes is imposed. Since RSWD carries the significant pressure energy, when passing through the interface from the opposite side, it reheats the portion of the injected gas. This reheating process normally degrades the efficiency of pressure energy transportation from the injected gas into GCR in the resonant tubes 14, and reduces the refrigeration performance of GWRD in the design conditions as well. On the other hand, the RSWD will interfere with the FPWD system if it is not controlled properly. In the varying flow state, the RSWD will intensify the disordered oscillation of jet. In order to diminish the reheating effect on the injected gas, the configuration of the closed end of resonant tubes 14 is replaced by the wave impedor 12. The wave impedor 12 is a short cylinder with a larger diameter which forms an enlarged cross-section linked at the end of resonant tubes 14. Once applied the wave impedor 12, the intensity of RSWD is artificially diminished and the reheating of the injected gas is eliminated. The length and diameter of the wave impedor 12 depends on ISWD parameters imposed. It is also noticed that the installation of impedor 12 will benefit the GWRD operation in the varying flow state by the elimination of RSWD effect on the high-speed jet oscillation in the oscillating chamber 8.

In summary, because the propagation of the periodic FPWD in the shear layer of the high speed jet drives the jet repeatedly sweeping over the each aperture of resonant tubes 14, the self-sustained oscillation of high speed jet couples in reverse with the resonant oscillation behavior of GCR to generate refrigeration effect on the portion of the injected gas. The generation of refrigeration is produced by the interactions of wave systems such as IPWD, RPWD inside the resonant tubes 14, and the injecting processes of high-speed jet into the resonant tubes 14. Both processes are critically triggered by the geometrical parameters of the nozzle 5 and the oscillating chamber 8, which dominate the interaction between the high speed jet and resonant tubes 14. When the flow state of supplying pressurized gas varies, it usually makes the GWRD operation degrade from off-designed point due to the change of the high-speed jet structure. Such a change will weaken or ruin the aforementioned two interaction processes and result in the failure of GWRD operation at the varying flow conditions. To retain the best performance of GWRD in the varying flow state, the apparatus in the present invention employs the mechanism to adjust the high-speed jet structure in the varying flow state to minimize the effects of additional adjustable mechanical structure on the internal leakage and mechanical complexity. Increasing the cooling efficiency of GWRD and reducing interfere of RSWD on the oscillating jet in steady or varying flow condition, the wave impedors 12 and chiller 14 are designed in the apparatus of present invention. The wave impedors 12 function to diminish the reheating effect on the injected gases caused by RSWD, and the chiller 14 is to reduce the temperature of the interface and to intensify the energy transportation between the injected gas and GCR. In addition, the thermal isolated connector 11 is used also to eliminate the heat conducted from the wall of the resonant tubes into the oscillation chamber 8.

With all the means, the apparatus in the present invention can be operated in the varying flow condition. The application of the flow regulator 9 makes the GWRD apparatus be able to work in a wide range of flow conditions and retain the performance at the designed-point. It is indicated that the steady self-sustained oscillation in the apparatus will be maintained by the proper manual adjustment of the nozzle 5 and the oscillating chamber 8. For the case with extreme high pressure drop, the apparatus in the present invention can be operated in series, and the maximum temperature drop in the varying flow state can be achieved by the separate adjustment of GWRD in the each stage.

The invention having been thus described, what is claimed as new and desired to secure by Letter Patent is:

1. A gaseous wave refrigeration apparatus comprises (a) a gaseous wave refrigeration apparatus having an adjustable nozzle, an adjustable oscillating chamber connected to said adjustable nozzle, a plurality of resonant tubes having open ends connected at apertures to said adjustable oscillating chamber penetrating thermal isolated connectors, and a flow stabilizer crossing over lower side of said adjustable oscillating chamber at the apertures of said resonant tubes, and wave impedors connected to the other ends opposite to said apertures of said plurality of resonant tubes, and a chiller embedding said resonant tubes at the other ends opposite to said apertures, (b) a resonant refrigeration means for varying flow state, using a pulsating flow of a laterally periodic jet oscillation from said adjustable nozzle in said adjustable oscillating chamber driven alternatively by each of said resonant tubes under varying flow conditions, wherein said jet oscillation under varying flow state, maintained by an adjustable pressure positive feedback loop comprising said stabilizer and said resonant tubes, couples with said adjustable oscillating chamber to create the intrinsic resonant frequency of a gaseous column in said resonant tubes under the varying flow state and governs a resonant cooling effect accompanied with said intrinsic resonant frequency of gaseous column in said resonant tubes under the adjustment of said adjustable nozzle and said adjustable oscillating chamber.

2. The gaseous wave refrigeration apparatus as recited in claim 1, further comprising:

(a) an operating plate with an upper side and lower side, containing said adjustable nozzle adjacent to one side of said adjustable oscillating chamber wherein provides a two dimensional configuration for said adjustable nozzle and said adjustable oscillating chamber, and apertures formed as a certain number of holes with female thread at an opposite side of said operating plate for connecting said resonant tubes by penetrating the said thermal isolated connectors with male thread to said adjustable oscillating chamber, which provides a pulsing flow production and a resonant cooling effect (b) a lower covering plate containing said stabilizer so as a declivitous slot passage in a position crossing over said adjustable oscillating chamber adjacent the open ends of said resonant tubes, which covers the lower side of said operating plate, and provides a path-way for discharging gases after energy conversion from the open ends of said resonant tubes to an outflow conduit, and divides the jet stream before entering said resonant tubes from the discharging gases, and (c) an upper covering plate, which covers the upper side of said operating plate, providing a holding base for a flow regulator wherein is mounted into said adjustable oscillating chamber through a regulator holding body within said operating plate in the direction perpendicular to the shape of the two dimensional configuration of said adjustable oscillating chamber and slid up or down to change the spacing of said two dimensional configuration within adjustable oscillating chamber in said direction perpendicular to said two dimensional configuration.

3. The gaseous wave refrigeration apparatus as recited in claim 2, wherein said operating plate provides a special geometrical shape for the said oscillating chamber to maintain a pulsing flow production and a resonant cooling generation, and wherein said resonant tubes are of rigid metal material with the high heat conductivity, of identical or variable diameter along the axis-direction of said resonant tubes and male thread at the open end of each said resonant tubes for providing a connection to said adjustable oscillating chamber through said thermal isolated connectors linked into said operating plate and the other end of each said resonant tubes for providing a connection to said wave impedor.

4. The gaseous wave refrigeration apparatus as recited in claim 2, wherein said operating plate provides a special geometrical shape for a pulsing flow production and a resonant cooling effect, and wherein said adjustable oscillating chamber in said operating plate is of a fan-shaped structure connected to said adjustable convergent nozzle with two converging sides with an offset at one end, with the other end forming an arc side of said fan-shaped structure of said adjustable oscillating chamber at the point where the open ends of said resonant tubes are connected to said adjustable oscillating chamber.

5. The gaseous wave refrigeration apparatus as re-cited in claim 2, wherein said operating plate provides a special geometrical shape for a pulsing flow production and a resonant cooling effect, and wherein said nozzle with convergent or convergent-divergent passage further includes a buffering chamber means in a passage to said nozzle with convergent or convergent-divergent passage in said operating plate for inducting pressurized gases to said nozzle with convergent or convergent-divergent passage.

6. The gaseous wave refrigeration apparatus as recited in claim 2, wherein said stabilizer comprises two declivitous surfaces and an inclining slot passage crossing over the upper surface of interspace between said oscillating chamber and the open ends of said resonant tubes in said operating plate, said passage having a width approximately equivalent to the diameter of said resonant tubes, forming a sharp angle with the upper surface of said operating plate in the direction of said nozzle with convergent or convergent-divergent passage, and thereafter providing a smooth pathway for gases discharged from said resonant tubes to an outflow conduit after the energy of said pressurized gases is convened into heat in said resonant tubes.

* * * * *